United States Patent [19]

Bourdeau

[11] 4,342,595

[45] Aug. 3, 1982

[54] CUBIC BORON NITRIDE AND METAL CARBIDE TOOL BIT

[75] Inventor: Romeo G. Bourdeau, Tequesta, Fla.

[73] Assignee: United Technologies Corporation, Hartford, Conn.

[21] Appl. No.: 104,253

[22] Filed: Dec. 17, 1979

[51] Int. Cl.[3] ..... B22F 3/14

[52] U.S. Cl. ..... 75/238; 75/240; 75/244

[58] Field of Search ..... 51/307, 309; 75/238, 75/244, 202, 205, 254

[56] References Cited

U.S. PATENT DOCUMENTS

| | | | |
|---|---|---|---|
| 3,743,489 | 7/1973 | Wentorf et al. | 51/307 |
| 3,767,371 | 10/1973 | Wentorf et al. | 51/307 |
| 3,852,078 | 12/1974 | Wakatsuki et al. | 51/307 |
| 3,868,234 | 2/1975 | Fontunella | 51/307 |
| 3,918,931 | 11/1975 | De Vries et al. | 51/307 |
| 3,944,398 | 3/1976 | Bell | 51/307 |
| 3,982,911 | 9/1976 | Lee | 51/307 |

FOREIGN PATENT DOCUMENTS

| | | | |
|---|---|---|---|
| 487952 | 9/1976 | U.S.S.R. | 75/244 |

OTHER PUBLICATIONS

"Manufacture of Superhard Tungsten Carbide", Kuratomi, Chemical Abstracts, vol. 78, 1973, 163134w.

"Boron Nitride-Based Cutting Tools", Fujikoshi, Chemical Abstracts, vol. 94, 1981, 126080k.

*Primary Examiner*—L. Dewayne Rutledge
*Assistant Examiner*—J. J. Zimmerman
*Attorney, Agent, or Firm*—C. G. Nessler

[57] ABSTRACT

Disclosed is an improved tool bit having 7 to 36 mole percent cubic boron nitride together with a metal carbide in a matrix containing a transition metal and a reactive metal sintering aid. A preferred tool bit consists by atomic percent of 52–79 tungsten carbide, 7–36 cubic boron nitride, 9–14 cobalt, and 0.2–2.5 zirconium. The new bits provide up to four times more life than tungsten carbide cobalt bits in machining nickel superalloys and are less costly than wholly cubic boron nitride bits.

Tool bits containing tungsten carbide and cubic boron nitride particulates are fabricable at relatively moderate hot pressing pressures and temperatures (7–28 MPa, 1350°–1500° C.) if included therein is a sintering aid selected from the group consisting of titanium, zirconium, hafnium, aluminum or mixtures thereof. The aforementioned reactive metal aids are preferably added as hydrides.

2 Claims, No Drawings

CUBIC BORON NITRIDE AND METAL CARBIDE TOOL BIT

BACKGROUND OF THE INVENTION

This invention relates to powder metal cutting tools, more specifically cutting tools containing tungsten carbide, cubic boron nitride, and a metal binder.

Metal carbide tool bits, such as tungsten carbide with cobalt, reflect a relatively refined art, developed over the past several decades. Typically they are fabricated by mixing, pressing, and sintering constituent powders. Previously many different combinations and variations of compositions have been evaluated and reported in the literature; these are reflective of the search for tougher and longer wearing tool bits.

Cubic boron nitride is a material which has received considerable attention over the past 20 years because in certain applications it outperforms tungsten carbide-cobalt. Cubic boron nitride (CBN) is a material of unique crystallographic structure, approaching diamonds in hardness; it is to be contrasted with the older and more familiar hexagonal boron nitride which is a soft material not suited per se as a cutting material. The properties and manner of preparation of CBN are described in Wentorf, Jr., U.S. Pat. No. 2,947,617. The use of CBN as an abrasive tool is described in De Vries, U.S. Pat. No. 3,918,931; the abrasive body produced is comprised of CBN grains bonded by a transition metal-aluminum alloy or other metal. The process of making CBN and CBN tool bits involves extremely high pressures and is a significant technological step. Accordingly, CBN tool bits are quite expensive compared to the carbide bits which they replace and there is a need for a material which has a better combination of improved performance and cost.

Heretofore nitrides in general, and hexagonal boron nitride in particular, have been incorporated in metal carbide tool bits in an effort to improve performance. For example, the early U.S. Pat. No. of Laise 1,858,247, mentions 0.1–1% boron nitride; Kieffer U.S. Pat. No. 3,741,733 discloses cutting tools comprising nitrides or nitride-carbide mixtures or carbon nitrides with metals of the iron and chromium group. In Kieffer the nitrides are those of the transition metal groups and do not include that of boron which of course is not a transition metal. Wentorf, Jr. et al. U.S. Pat. No. 3,743,489 discloses cutting tools of CBN compacts. The compacts are formed from crystals in the size range of 1–10 micrometers and are bonded together at very high pressures with aluminum containing alloys of various transition element metals. Wentorf, Jr. et al also disclose the utility of CBN compacts, both by themselves and when bonded to conventional sintered carbide cutting tool substrates. Yates U.S. Pat. No. 3,409,416 discloses transition metal nitride base tool bits having metal binders of the refractory metal type and optionally containing substantial amounts of other materials including a carbide such as aluminum and titanium carbide. Boron nitride is mentioned in the Yates patent but it is evident from the disclosure that the nitride is the conventional (hexagonal) boron nitride, with a maximum size of about 30 micrometers.

Based on the above art it can be seen that the cutting tool bits known heretofore which contained boron nitride were comprised of either of two basic constructions: (a) those containing the hexagonal form of the nitride in complex combination with various other materials, wherein because of its lack of inherent hardness the hexagonal boron nitride would not appear to be a significant element in enhanced tool bit wear resistance; and (b) those containing CBN as a compact in combination with a metal alloy, wherein the compact was the tool bit in its entirety or in the alternative was adhered to a hard supporting substructure.

Additionally, it is evident from the art relating to CBN that extremely high pressures, of the order of 5000 MPa, are required to obtain the density and integrity of particle bonding necessary for a good tool bit. Devices to attain such high pressures increase the cost of tool bits and make impossible the fabrication of large ones.

SUMMARY OF THE INVENTION

An object of the invention is to provide a cubic boron nitride (CBN) containing tool bit which has enhanced performance over previously known tungsten carbide-metal matrix tool bits, but which does not have the high cost of known CBN compacts. A further object of the invention is to provide a method by which CBN particulate is strongly bonded into a metal matrix at low pressure, to form a tool bit.

According to the invention, an improved hot pressed tool bit is comprised of cubic boron nitride and tungsten carbide particulates bonded in a metal matrix containing a transition metal and a reactive metal sintering aid. In contrast with CBN tool bits of the past, the concentration of CBN is less than about 36 mole percent. Further, the inclusion of the sintering aid which is chosen from the group consisting of zirconium, titanium, hafnium, and mixtures thereof, increases the bonding strength of the CBN, and allows relatively modest bonding pressures, about 1 percent of those necessary to form CBN tool bits in the prior art.

The CBN is preferably added as a particulate of 10–45 micron average size; the carbide and periodic table transition metal as a particulate of 0.1–10 micron average size; and the sintering aid as a metal hydride of 1–50 micron average size (the hydrogen being evolved during bonding). Typical sintering conditions include 7–28 MPa and 1350°–1500° C. for 1 to 30 minutes.

The preferred materials for a tool bit include cubic boron nitride, tungsten carbide, cobalt, and zirconium: for these the usable compositional ranges on an atomic or mole percent basis are 52–79 WC, 7–36 BN, 9–14 Co, 0.2–2.5 Zr. Tool bits of higher general performance will have the narrower atomic composition 64–76 WC, 11–13.5 Co, 10–24 BN, 0.3–1.0 Zr. Other metal carbides and transition metals may be substituted in part of whole in the foregoing compositions.

Advantages of the invention are that the cost of tool bits is lowered due to both the lower useful concentration of CBN and lower tool manufacturing cost. The inventive material is found to have superior hardness and wear resistance to a conventional tungsten carbide-cobalt tool bit material, producing a life as much as four times greater when machining a representative nickel base superalloy.

The foregoing and other objects, features and advantages of the present invention will become more apparent from the following description of preferred embodiments.

DESCRIPTION OF THE PREFERRED EMBODIMENT

A preferred tool bit is comprised of a hot pressed mixture of commercially available powders. Tungsten carbide-cobalt (WC+Co) powder of minus 10 micron particle size range and containing about 5 weight percent cobalt is obtained from the Kennametal Company of Latrobe, Pa. Cubic boron nitride powder is obtained from the General Electric Company, Fairfield, Conn., with an average crystal size about 20 microns. (Cubic Boron Nitride is hereinafter referred to as "CBN" for convenience in the text and formulae, and is indicative of the chemical compound BN with a cubic crystal structure. In contrast, WC of course represents the chemical compound of tungsten and carbon.) Zirconium hydride ($ZrH_2$) powder is of a standard laboratory reagent grade; a friable very fine powder obtainable from Alpha Chemicals, Beverly, Mass. It is possible to vary somewhat from the foregoing sizes. But as will become evident the WC+Co provides the matrix for the CBN while the $ZrH_2$ is a sintering aid which promotes wetting and bonding of the CBN to the matrix.

To formulate a preferred composition tool, the foregoing constituents are mixed so that, after sintering and resultant evolution of hydrogen, the weight percents of the constituents are 2.3 CBN, 0.3 Zr, balance WC+5 Co. In weighing the raw materials, the weight of hydrogen—which is only 2.14 percent of $ZrH_2$—may be adjusted for. But as a practical matter it is not of significant weight effect. To effect good mixing sufficient acetone or like volatile liquid is added to the powders to form a liquid slurry. The powders are blended to a homogeneous mix using any of a number of conventional powder blending apparatuses well known to the art. When intimately mixed, the powders are dried by evacuation or any other means suited to volatilize the acetone without contaminating the powder. Conventional graphite die pressing apparatus is used to consolidate the mixture, first cold, and then with heat. Preferably the mixture is precompacted at 1.4 to 14 MPa (200–2000 psi). The chamber containing the die is then evacuated and maintained at reduced pressure of about 1 mm Hg or better; in the alternative it is evacuated and back-filled with an inert gas such as argon. While a pressure of about 14 MPa is maintained, the mixture is heated to 1475° C. for 10 minutes, whereupon the apparatus is cooled and the consolidated compact is removed. Naturally, upon heating of the mixture, the hydrogen included in the zirconium hydride is driven off and the resultant tool bit has the composition by weight percent of 92.5 WC, 4.9 Co, 2.3 CBN, 0.3 Zr. It is found by analysis and experiment that the CBN and WC are present in substantially the crystallographic and chemical forms in which they were originally combined in the mix, the time and temperature of hot pressing having been chosen so that alterations are avoided. During formation of the compact, the liquid which commonly forms at the W-C-Co eutectic will include Zr. This liquid will wet the CBN to secure bonding to the matrix, which will of course be predominantly cobalt. In like manner, other similar tool bits have been fabricated with the weight compositions shown in Table I. The tool bits were found to scratch a standard WC+Co tool bit and in machining a nickel superalloy were found to provide up to four times greater life than plain WC+Co.

TABLE I

COMPOSITIONS HOT PRESSED TO TOOL BITS

| | Percent | | | |
|---|---|---|---|---|
| | CBN | WC | Co | $ZrH_2$ |
| Specimen A | | | | |
| weight | 2.3 | 92.5 | 4.9 | 0.3 |
| atomic | 14.2 | 72.5 | 12.8 | 0.5 |
| Specimen B | | | | |
| weight | 3.6 | 90.2 | 4.7 | 0.3 |
| atomic | 21.1 | 66.8 | 11.7 | 0.4 |
| Specimen C | | | | |
| weight | 26 | 67.3 | 3.7 | 4 |
| atomic | 70 | 22.9 | 4.2 | 2.9 |

The invention is more suitably expressed hereafter in its various modes by use of atomic percent (a/o), rather than weight percent. The just described tool bit, in atomic percent can be expressed as 72.5 WC+12.8 Co, 14.2 CBN, and 0.5 Zr.

I have made a number of experimental tool bits and comparatively evaluated them according to criteria which include (a) microporosity as viewed by light and SEM microscopes, indicative of both the degree of consolidation and particle tear-out during specimen preparation; (b) wear resistance when abraded by a metal bonded diamond grinding wheel; and (c) machining performance, including resistance to cratering and brittle fracture when machining a nickel superalloy such as IN-100. Of course, these are criteria that are applicable to conventional WC+Co tool bits. As is well known, WC+Co tool bits may have varying content of Co matrix material: when a higher percent, toughness will be increased and wear resistance decreased; and when low, toughness is decreased and wear resistance is increased. Within certain useful limits, the tool bit composition selected will depend on the particular application. Rather simply, the useful limits are, first, that the wear resistance may be so decreased as to not produce a worthwhile benefit compared to a high speed tool steel bit, and; second, that the tool bit may be so brittle that the cutting edge fails with the least of provocation during machining, e.g., inadvertent error in machining parameter, vibration, interruption of cut, localized "hard spots" and the like. These same limiting criteria, although not subject to exact definition, are applicable to the instant invention tool bits by comparison to conventional WC+Co bits. And, of course, another goal for the invention is to maximize the ratio of tool bit cost to performance through reduced manufacture cost and lesser amount of CBN.

In experimental testing I have varied the compositions and concluded that the following are the broadest usable ranges by atomic percent: 52–79 tungsten carbide, 7–36 cubic boron nitride, 9–14 cobalt, 0.2–2.5 zirconium (by weight percent about 85.3–93.2 WC, 1.6–8 BN, 4.7–5 Co, 0.2–2 Zr). More preferably, the composition is by atomic percent 64–76 tungsten carbide, 11–13.5 cobalt, 10–24 cubic boron nitride and 0.3–1.0 zirconium (by weight percent about 90.3–93.3 WC, 4.7–5 Co, 1.5–4.3 BN, 0.2–0.7 Zr). The Zr will be prevalently alloyed in the cobalt matrix.

The broadest ranges above are established in the following manner: when the CBN is less than 7 mole percent then there is inconsequential improvement in wear resistance of a tool bit compared to a conventional WC+Co bit having no CBN. At the other end of the range, when the CBN exceeds about 36 mole percent then the resultant tool bits of my invention are found to be unacceptably brittle and prone to CBN particle "pull out" during machining. For the more preferred embodiment ranges stated above, the tool bits will be more adapted than the broader range bits to transients in machining conditions without failure.

The percentage of CBN in the WC-Co-Zr tool bit may also be characterized on a volumetric basis, and by this criterion I have found that usable tool bits will contain about 7 to 36 percent. And my foregoing compositions are based on a WC-Co ratio of 95–5. As is well known the percent cobalt in useful commercial tool bits may be between 3 and 12 weight percent. These commercial WC-Co materials will be useful in my invention and their inclusion with the atomic amounts of CBN and Zr set forth in the above formulae will result in a readily calculable change in the atomic amounts of WC and Co.

I have discovered that it is necessary to include a reactive metal such as zirconium in the composition of the tool bit in order to aid the bonding of the CBN particles for all the above combinations of CBN and WC+Co. If no zirconium is present, then the CBN is not adequately bonded and the tool bit does not have adequate wear resistance due to tear-out of the CBN. At least 0.2 a/o Zr must be included. The more zirconium which is included, the more the bonding is enhanced. In experiments I varied the Zr up to 3 a/o, and determined that at levels above 2.5 a/o the wear performance of the tool bit was degraded. I speculate that this is due in part to the fact that the Zr embrittles the cobalt matrix which bonds the WC and CBN.

In experiments CBN was hot pressed in a nickel powder matrix using separately dies of boron nitride, graphite, tantalum, and combinations thereof, with the various presence of titanium, aluminum, and zirconium foils in contact with the nickel-CBN mix. The foils alloyed with the nickel and were demonstrated to act as sintering aids. It was found that Zr was considerably more effective than Ti or Al, although there was demonstrable improvement for all sintering aids. Thus, I conclude that reactive metals which are similar in chemical behavior or aggressiveness toward refractories as the aforementioned materials will also carry out the object of the invention. In total, I include the metal hafnium and the aforementioned zirconium, titanium, and aluminum as well as mixtures thereof. I believe the inclusion of the titanium subgroup metals (Ti, Zr, Hf) as sintering aids in my tool bits to be especially advantageous and novel. Accordingly, these metals may be atomically substituted for Zr in the above-mentioned atomic composition ranges.

In other experiments I determined that CBN could be readily and durably consolidated into a matrix of IN-100 nickel superalloy (by weight 12.4 Cr, 18.5 Co, 4.3 Ti, 5.0 Al, 3.2 Mo, 0.8 V, 0.06 Zr, 0.02 B, 0.07 C, balance Ni). This becomes understandable in light of my experiments with sintering aids in that the Al and Ti content of the IN-100 is appreciable.

In my further experiments I added the zirconium and titanium in the form of their hydrides to the powder mixture before cold pressing. Not only are the hydrides more friable and therefore more readily made into and included as fine dispersions throughout the mixture, but they are also less chemically reactive and therefore less prone to contamination prior to sintering. Of course, during the sintering operation the high temperature drives off the combined hydrogen to the surrounding environment. While I prefer the foregoing procedure, provided the sintering aid can be added in a form which provides good dispersal, it would also appear feasible to add the sintering aid as a metal or metal alloy, or in another chemical combination than the hydride.

The average particle size of the CBN was varied between 10 and 45 microns in separate tool bit formulations. Concentrations of up to 40–50 volume percent were attained, with about 50–70 percent being attained by use of bimodal particle distributions. It is believed that the higher concentrations (of the order of 90 volume percent) aimed for and achieved in the prior art are achieved through severe particulate crushing at the extremely high (~5000 MPa) pressures heretofore used to achieve consolidation. In the process of my invention, I believe the concentration of CBN may be increased up to 80% by cold pressing (sufficient to crush the CBN) at pressures of 350 to 700 MPa.

When my aforementioned compositions are formed from the sintered constituents, the bonding parameters are chosen so that the wear resisting CBN is not chemically attacked by the matrix or otherwise deleteriously altered in its structure. My experiments show that CBN by itself may be heated to 1500° C. for at least 10 minutes while retaining its cubic structure; thus my bonding parameters are acceptable. When hot pressing in graphite dies, there may be a pickup in carbon content by the cobalt (or like metal) matrix, above about 1320° C. However, this pickup can be minimized if deleterious by minimizing the bonding temperatures and times. Based on my experiments I prefer bonding temperatures in the 1350°–1500° C. range for 1–30 minutes, and pressures in the 7–28 MPa (1000–4000 psi) range.

The inventive tool bit composition may be pressed conjunctively in a die either with unaltered WC+Co powder or a WC+Co solid so that after pressing there will result a tool bit comprised of a first portion having the inventive composition bonded to a second portion having the more conventional formulation. Thus, in use the second (and presumably lower cost) portion will comprise a substructure which provides body and support to the first portion when it is physically disposed to be the cutting edge or face.

While my invention is described in the context of WC+Co as one of the base constituents, it is within my contemplation that other more complex carbide tool bit materials known in the art may be incorporated with CBN in a tool bit according to the invention taught herein. Other metal matrices than the Co of my invention's preferred embodiment may be used in the practice of my invention, such as are known in other tungsten carbide containing tool bits. These are almost entirely selected from the transition metal elements of the periodic table. In the practice of my invention, in addition to cobalt I contemplate especially the use of metals from the traditional transition metal Group VIII; that is especially the metals, Fe and Ni. Cr and other alloying elements of steel, nickel, and cobalt base alloys may be included in the matrix.

My improved tool bits, while not as hard and wear resistant as CBN bits of the prior art, are less prone to brittle fracture at the tool bit edge during machining of superalloys, and are fabricated by a process wherein pressures and costs are lower.

To further illustrate my invention, the following examples are presented.

EXAMPLE 1

A WC-Co powder containing 5 weight percent cobalt was mixed with 3.6 weight percent of 20 micron size cubic boron nitride crystals and 0.3 weight percent of Zr in the form of $ZrH_2$. The mixture was placed on a standard WC-Co powder mixture containing 5 weight percent cobalt. To produce a 1.3 cm diameter cutting tool 5 mm thick, 8.8 grams of the WC-Co mixture and 1.6 grams of the WC-Co-CBN-$ZrH_2$ surfacing mixture were employed. The above powder mixtures were hot pressed under a vacuum less than 1 mm of mercury for 10 minutes at 1400° C. and under 14 MPa pressure. A hard and dense material was produced which was found to scratch a standard WC-Co tool material.

EXAMPLE 2

A WC-Co powder mixture containing 5 weight percent cobalt was mixed with 2.3 weight percent cubic boron nitride and 0.3 weight percent Zr in the form of $ZrH_2$. The mixture was placed in the die upon a quantity of a standard WC-Co powder mixture containing 8.4 volume percent of cobalt. To produce a 1.3 cm diameter cutting tool 5 mm thick, 8.8 grams of the WC-Co mixture and 1.7 grams of the WC-Co-CBN-$ZrH_2$ surfacing mixture were employed. The above powder mixtures were hot pressed under vacuum for 10 minutes at 1400° C. and under 14 MPa pressure. A hard and dense material was produced which had a tool life as much as four times the tool life of a standard WC-Co material.

Although this invention has been shown and described with respect to a preferred embodiment, it will be understood by those skilled in this art that various changes in form and detail thereof may be made without departing from the spirit and scope of the claimed invention.

Having thus described a typical embodiment of my invention, that which I claim as new and desire to secure by Letters Patent of the United States is:

1. A tool bit comprised of a mixture of cubic boron nitride particles and metal carbide particles in a metal matrix containing both a transition metal and a sintering aid, consisting by atomic percent of 52–79 tungsten carbide, 7–36 cubic boron nitride, 9–14 cobalt, and 0.2–2.5 zirconium (by weight percent, about 85–93 tungsten carbide, 1.6–8 boron nitride, 4.7–5.0 cobalt, 0.2–2 zirconium).

2. A tool bit of claim 1 consisting by atomic percent of 64–76 tungsten carbide, 11–13.5 cobalt, 10–24 cubic boron nitride and 0.3–1.0 zirconium (by weight percent, about 90–93 tungsten carbide, 4.7–5.0 cobalt, 1.5–4.3 boron nitride, 0.2–0.7 zirconium).

* * * * *